US005851304A

United States Patent [19]

Giraud et al.

[11] Patent Number: 5,851,304

[45] Date of Patent: Dec. 22, 1998

[54] PROCESS FOR PICKLING A PIECE OF STEEL AND IN PARTICULAR A SHEET STRIP OF STAINLESS STEEL

[75] Inventors: Henri Giraud, Geeugnon; Bernard Vialatte, Creusot; Martine Lauvergne, Gueugnon, all of France

[73] Assignee: Usinor Sacilor, Puteaux, France

[21] Appl. No.: 807,634

[22] Filed: Feb. 27, 1997

[30] Foreign Application Priority Data

Feb. 27, 1996 [FR] France ..... 96 02405

[51] Int. Cl.[6] ..... C23G 1/08

[52] U.S. Cl. ..... 134/3; 134/41

[58] Field of Search ..... 134/2, 3, 41

[56] References Cited

U.S. PATENT DOCUMENTS

| | | | |
|---|---|---|---|
| 3,310,435 | 3/1967 | Robinson, Jr. et al. | 134/41 |
| 3,385,734 | 5/1968 | Barkley | 134/41 |
| 3,445,284 | 5/1969 | Robinson, Jr. et al. | 134/41 |
| 4,323,240 | 4/1982 | Oster | 134/41 |
| 5,164,016 | 11/1992 | Henriet et al. | 134/2 |
| 5,332,446 | 7/1994 | Didier et al. | 134/3 |

FOREIGN PATENT DOCUMENTS

| | | |
|---|---|---|
| A-0 505 606 | 9/1992 | European Pat. Off. . |
| A-2 551 465 | 3/1985 | France . |
| A-2 587 369 | 3/1987 | France . |
| A-0 501 867 | 9/1992 | France . |
| A-37 19 604 | 12/1988 | Germany . |
| 50-47826 | 4/1975 | Japan . |
| 2 000 196 | 1/1979 | United Kingdom . |

OTHER PUBLICATIONS

JP 55138081, Japanese (Abstract) Dated Oct. 28, 1980.
JP 63216986, Japanese (Abstract), Dated Sep. 9, 1988.
JP 2205692, Japanese (Abstract) Dated Aug. 15, 1990.
JP 58073778, Japan (Abstract) Dated May 4, 1983.

*Primary Examiner*—Jill Warden
*Assistant Examiner*—Saeed Chaudhry
*Attorney, Agent, or Firm*—Oblon, Spivak, McClelland, Maier & Neustadt, P.C.

[57] ABSTRACT

The process comprises applying an aqueous pickling solution containing hydrochloric acid and ferric and ferrous pickling irons in solution, and, for the purpose of maintaining a constant pickling power of the aqueous solution of hydrochloric acid having a pH lower than 1, maintaining the concentration of $Fe^{3+}$ ions at a value between 1 g/litre and 300 g/litre, by reoxidation by means of an oxygenation of the $Fe^{2+}$ ions produced during the pickling, the REDOX potential being maintained at a value between 0 and 800 mV, the potential being measured between a platinum electrode and a reference AG/AGCl electrode which are placed in the solution.

10 Claims, No Drawings

PROCESS FOR PICKLING A PIECE OF STEEL AND IN PARTICULAR A SHEET STRIP OF STAINLESS STEEL

The invention relates to a process for pickling a piece of steel and in particular a sheet strip of stainless steel.

The Japanese patent N° JP S 56-171638 discloses a process for descaling a steel wire in which the wire is pickled in a bath of hydrochloric acid for 20 to 40 minutes, the bath having a concentration of hydrochloric acid of between 10 and 20% by weight. In order to accelerate the pickling, the acid concentration of the bath is modified. However, it is taught that an excessively concentrated solution results in fumes and requires increasing the size of the installations with increased cost. According to the technique proposed in this document, an amount of $FeCl_2$ at a concentration which might be as much as to cause saturation is added together with an amount of $FeCl_3$ so that the oxidoreduction potentials of $Fe^{3+}/Fe^{2+}$ are measured in the course of the descaling. The potential is adjusted by addition of $FeCl_3$ through an injection nozzle. The pickling procedure consists in the dissolution by HCl of the ferrous substrate which gives off hydrogen.

It is also mentioned in this document that, generally, pickling baths based on hydrochloric acid result in a corrosion of the steel of the pinhole type.

A bath is also known, for example from the patent JP H2 205692 for pickling stainless steels in which products hot rolled or subjected to an annealing are pickled in a solution of sulphuric acid containing $Fe^{3+}$ and $Fe^{2+}$ ions, said solution containing at least 10 g/litre of iron, the pickling being carried out by aerating the solution with air blown at a rate of at least 100 ml/min and per litre of solution.

In this type of bath, the blowing of air has the sole function to stir the solution since it is well known that, in a sulphuric medium, the potential of oxidation of the iron is such that a simple stirring with air cannot oxidize the $Fe^{2+}$ ions into $Fe^{3+}$ ions.

Further, the Utility Certificate No FR 2551465 associated with the patent EP N° 0236354 disclose a process for continuously pickling a strip of stainless steel in which there is employed a pickling bath comprising principally hydrofluoric acid containing ferric ions, the pickling of the steel strip being carried out by maintaining the ferric iron content at at least 15 g/l by oxidation of the bath by an injection of air or the addition of another oxidizer while maintaining the REDOX potential of said bath within a range of between 0 and 800 mV.

These documents teach the oxidizing function of the air which oxidizes the $Fe^{2+}$ ions into $Fe^{3+}$ ions, the pickling reaction occurring without giving off hydrogen.

In the field of the pickling of stainless steels, there are a considerable number of documents which describe pickling processes of which the baths are composed of a mixture of two or three of the aforementioned acids for the purpose of avoiding the conventional use of nitric acid which has the drawback of producing pollutant derivatives of this acid of the NOx type.

In the production of a strip of a rolled sheet of steel and in particular stainless steel on a continuous production line, the sheet is subjected to in succession:

- a mechanical treatment, for example levelling under tension and/or shot blasting,
- a primary pickling,
- a transforming operation, as for example rolling,
- annealing operations,
- a final pickling,

- a finishing operation, as for example a cold rolling of the "skin pass" type.

A very considerable reduction in the duration of the steel pickling treatment is imposed so as to avoid an accumulation or gathering of the strip between the various devices of the production line. Such a production line has the advantage of reducing intermediate handling and stock.

On this line, there is the problem of the pickling and in particular of a pickling within an imposed short period of time in order to avoid imperatively an accumulation or gathering of the treated strip between the various devices arranged in succession on the strip production line.

A large number of options in the pickling processes have been envisaged in taking into account the most important criterion of the pickling which becomes the pickling rate or the minimum time during which the strip must be in contact with the pickling solution.

An object of the invention is to propose a pickling process which effects the pickling of a piece of steel and in particular a strip of stainless steel, within a very short period of time, the pickling time being compatible with the imposed periods on a production line producing the piece or strip of sheet.

The invention therefore provides a process for pickling a piece of steel and in particular a sheet strip of stainless steel, comprising applying an aqueous pickling solution containing hydrochloric acid and ferric and ferrous pickling ions in solution, and, for the purpose of maintaining a constant pickling power of the aqueous solution of hydrochloric acid having a pH lower than 1, maintaining the concentration of $Fe^{3+}$ ions at a value of between 1 g/litre and 300 g/litre, by reoxidation by means of an oxygenation of the $Fe^{2+}$ ions produced during the pickling, the REDOX potential being maintained at a value between 0 and 800 mV, the potential being measured between a platinum electrode and a reference Ag/AgCl electrode which are placed in the solution.

Other features of the invention are:

- the reoxidation of the Fe2+ ions by oxygenation is carried out by aeration of the pickling solution,
- the aeration of the pickling solution is carried out by means selected from the group comprising: pumping and discharge of the solution in the open air, bubbling, stirring, injection of a gas containing the oxygen element, spraying of the pickling solution in an enclosure containing air,
- the reoxidation is completed by the addition of compounds selected from the group comprising: peroxides and/or persalts and preferably hydrogen peroxide ($H_2O_2$) and/or potassium permanganate ($KMnO_4$),
- the treating solution preferably has a concentration of hydrochloric acid of between 35 g/litre and 250 g/litre,
- the treating solution is applied at a temperature of between 10° and 95° C. and preferably between 65° C. and 85° C.,
- the piece to be treated is heated prior to the application of the solution,
- the period of application of the solution on the strip is less than 2 min.
- the REDOX potential is adjusted between 0 mV and 800 mV and preferably between 400 mV and 600 mV by the addition of a compound and/or an oxidizing gas.

The invention also relates to the use of the pickling process according to the invention in the field of the accelerated pickling of a piece of steel and in particular a strip of stainless steel in an installation for the continuous line production of the steel strip.

The invention also concerns a continuous production line for producing a strip of rolled sheet of steel and in particular stainless steel in which the strip is subjected to in succession:

a mechanical treatment, for example a levelling under tension and/or shot blasting, a primary pickling, a transforming operation such as for example rolling, annealing operations, a final pickling, a finishing operation such as for example a cold rolling of the "skin pass" type at least one of the picklings comprising applying an aqueous pickling solution comprising hydrochloric acid and ferric and ferrous pickling ions in solution, and, for the purpose of maintaining a constant pickling power of the aqueous solution of hydrochloric acid having a pH lower than 1, maintaining the concentration of $Fe^{3+}$ ions at a value of between 1 g/litre and 300 g/litre by reoxidation by means of an oxygenation of the $Fe^{2+}$ ions produced during the pickling, the REDOX potential being maintained at a value of between 0 and 800 mV, the potential being measured between a platinum electrode and a reference Ag/AgCl electrode which are placed in the solution.

The following description will explain the invention.

Among the various known pickling processes, the pickling baths based on hydrochloric acid are considered to produce a corrosion of the surface of the pickled pieces, this corrosion being of the pinhole type.

Non-polluting pickling processes employed preferably solutions comprising, alone or in combination, at different concentrations, sulphuric and hydrofluoric acids.

Various pickling solutions have been tested in order to obtain a rapid pickling in particular on a strip of stainless steel so that this strip may be used, in a continuous manner, after pickling, in an installation comprising a production line producing a sheet strip, the pickling installation being inserted in said line, between devices transforming the steel, such as for example a leveller employing tension and a rolling mill.

Preferably, pickling tests have been carried out with a single acid so as to avoid the formation of insoluble complex compounds, the solution being intended to be recycled, i.e. re-used for pickling.

In a comparative test of pickling solutions containing a sulphuric, hydrofluoric or hydrochloric acid, it was found that the hydrochloric acid in a concentrated solution had a surprising effectiveness as concerns the pickling rate.

The following were compared:

an aqueous pickling solution A of sulphuric acid having a normality F N, corresponding to a concentration of 196 g/litre of acid and containing 60 g/litre of total iron.

an aqueous pickling solution B of hydrofluoric acid having a normality 4N, corresponding to a concentration of 80 g/litre acid and containing 60 g/litre of total iron.

an aqueous pickling solution C of hydrochloric acid having a normality 4N, corresponding to a concentration of 146 g/litre acid and containing 60 g/litre of total iron.

These pickling solutions were tested in respect of effectiveness of the pickling, by taking into account their maximum effectiveness by the adjustment of the REDOX potential corresponding to various concentrations of acid employed. The period of stay in the solutions is adapted to the composition of the steel and to the type of oxide to be removed.

In the pickling test with the aqueous solution of hydrochloric acid, the REDOX potential is fixed at 460 mV relative to a reference Ag/AgCl electrode, the potential being maintained constant by the injection of air and an additional supply of hydrogen peroxide.

The following table shows the various pickling rates measured as loss of material in grams per square metre and per second for various grades of steel:

| Steel | Solution A | Solution B | Solution C (invention) |
|---|---|---|---|
| AISI 304 | 0.41;0.37 | 0.42;0.37 | 0.59 |
| | 0.28;0.27 | 0.31;0.27 | 0.63;0.56 |
| AISI 316L | 0.31 | 0.40 | 0.53 |
| AISI 430 | 0.46;0.46 | 0.92;0.90 | 1.6;1.1 |
| AISI 430 Ti | 0.65;0.67 | 1.01;0.99 | 1.5;1.8 |
| AISI 409 | 0.55;0.58 | 0.93;0.96 | 1.3;1.6 |

Consequently, the pickling in a hydrochloric solution is remarkably effective as concerns the pickling rate. Further, it is found that, for a given pickling duration, the traces of oxide are distinctly less after pickling in a hydrochloric solution.

Further, the surface of the strip pickled with a hydrochloric solution has a white appearance, without pinholes, while the surface of the strip pickled with an aqueous solution of sulphuric acid has a blackish appearance.

After this remarkable comparison, various tests were carried out for determining the various parameters for optimising the pickling solution:

Variation of the hydrochloric acid concentration:

Pickling tests were carried out with aqueous solutions C of hydrochloric acid with a normality between 3N and 5N, corresponding to a concentration of between 108 g/litre and 180 g/litre of acid and containing 60 g/litre of total iron.

In these pickling tests, the REDOX potential is fixed at 460 mV relative to a reference AG/AGCl electrode, the potential being maintained constant by injection of air and an additional supply of hydrogen peroxide, the temperature of the solution being maintained at 80° C.

Under these conditions, the pickling rate increases with concentration in acid and may reach values up to two to three times higher than the values with the baths of reference A or B.

In order to achieve such a pickling effectiveness, the oxidoreduction potential of the bath according to the invention is controlled, this control being effected by addition in particular of hydrogen peroxide in addition to the injection of air, which permits maintaining a high level of attack and treating continuously, in particular on a rolling line, the sheet strips on which the solution is applied.

Variation of the concentration of total iron:

Pickling tests were carried out with aqueous pickling solutions C of hydrochloric acid having a normality 4N, corresponding to a concentration of 146 g/litre of acid and containing 30 g/litre to 250 g/litre of total iron.

With a concentration of iron of about 250 g/litre, the iron is at the limit of solubility in the acid solution.

In these pickling tests with the hydrochloric solution, the REDOX potential is fixed at 460 mV relative to a reference AG/AGCl electrode, the potential being maintained constant by injection of air and an additional supply of hydrogen peroxide, the temperature of the solution being maintained at 80° C.

Under these conditions, the pickling rate increases with concentration of iron and reaches values up to three times higher than the values obtained with the conventional baths A or B.

Variation of the temperature:

The temperatures of the pickling solution may vary from 10° C. to 95° C. and preferably between 65° C. and 85° C. The pickling rate increases with the temperature. Below 70° C., the pickling rate increases moderately with the temperature, when the temperature reaches 70° C. to 85° C., the pickling rate increases by nearly 20%. Although above a certain temperature a slight evaporation may occur, it is possible to contemplate using in an installation a closed enclosure which permits the use of the solution at a temperature higher than 85° C., associated with a device for condensating the solution for its return it for re-use.

In order to benefit from the effect of the temperature, the piece or the sheet strip may be heated to compensate for the thermal inertia effects.

Variation of the REDOX potential:

The measure of the REDOX potential is a means for controlling the pickling quality of the solution in an industrial installation for an optimization of the pickling rate and the maintenance of constant quality with constant pickling effectiveness.

The pickling rate may increase from 30% to 50% when the REDOX potential is brought from 400 mV to 600 mV.

The pickling rate may be modulated by adding to the hydrochloric acid bath according to the invention an amount of another acid, such as for example hydrofluoric acid, in a proportion lower than 40 g/litre.

What is claimed is:

1. Process for pickling a piece of steel and in particular a strip of stainless steel, comprising: applying an aqueous pickling solution containing hydrochloric acid and ferric and ferrous pickling ions in solution, and, for the purpose of maintaining a constant pickling power of said aqueous solution of hydrochloric acid having a pH lower than 1, maintaining the concentration of $Fe^{3+}$ ions at a value between 1 g/litre and 300 g/litre by reoxidation by means of an oxygenation of the $Fe^{2+}$ ions produced during said pickling, the REDOX potential being maintained at a value between 400 and 600 mV, said potential being measured between a platinum electrode and a reference AG/AGCl electrode which are placed in said solution.

2. Process according to claim 1, wherein said reoxidation of said $Fe^{2+}$ ions by oxygenation is effected by aeration of said pickling solution.

3. Process according to claim 1, wherein said aeration of said pickling solution is effected by means selected from the group comprising: pumping and discharge of the said solution in the open air, bubbling, stirring, injection of a gas containing the oxygen element, spraying of said pickling solution in an enclosure containing air.

4. Process according to claim 1, wherein said reoxidation is completed by addition of compounds selected from the group comprising: peroxides, persalts, hydrogen peroxide $H_2O_2$, potassium permanganate $KMnO_4$.

5. Process according to claim 1, wherein said solution has a concentration of hydrochloric acid of between 35 g/litre and 250 g/litre.

6. Process according to claim 1, comprising applying said treating solution within a temperature range between 10° C. and 95° C.

7. Process according to claim 1, comprising applying said treating solution within a temperature range between 65° C. and 85° C.

8. Process according to claim 1, comprising heating said piece to be treated prior to said application of said solution.

9. Process according to claim 1, comprising applying said solution to said strip during a period of less than 2 min.

10. Process for effecting an accelerated pickling of a piece of steel and in particular a strip of stainless steel in a continuous production line producing said strip, comprising: applying an aqueous pickling solution containing hydrochloric acid and ferric and ferrous pickling ions in solution, and, for the purpose of maintaining a constant pickling power of said aqueous solution of hydrochloric acid having a pH lower than 1, maintaining the concentration of $Fe^{3+}$ ions at a value between 1 g/litre and 300 g/litre by reoxidation by means of an oxygenation of the $Fe^{2+}$ ions produced during said pickling, the REDOX potential being maintained at a value between 400 and 600 mV, said potential being measured between a platinum electrode and a reference AG/AGCl electrode which are placed in said solution.

* * * * *